United States Patent [19]

Lyle

[11] 4,428,678

[45] Jan. 31, 1984

[54] CONCRETE VIBRATOR

[76] Inventor: John S. Lyle, 671 Cody St., Denver, Colo. 80215

[21] Appl. No.: 431,593

[22] Filed: Sep. 30, 1982

[51] Int. Cl.[3] ..... B01F 11/00

[52] U.S. Cl. ..... 366/124; 366/122

[58] Field of Search ..... 366/124, 125, 126, 120, 366/122; 175/56

[56] References Cited

U.S. PATENT DOCUMENTS

| | | | |
|---|---|---|---|
| 2,187,088 | 1/1940 | Malan . | |
| 2,215,888 | 9/1940 | Swarthout | 366/124 X |
| 2,763,472 | 9/1956 | Fontaine | 366/125 X |
| 3,182,964 | 5/1965 | Malan | 366/125 |
| 3,235,230 | 2/1966 | Malan . | |
| 3,282,570 | 11/1966 | Malan | 366/125 |
| 3,400,913 | 9/1968 | Matson | 366/125 |
| 3,650,509 | 3/1972 | Swerdfeger . | |
| 4,293,231 | 10/1981 | Lyle . | |

*Primary Examiner*—Robert W. Jenkins

[57] ABSTRACT

A vibrator is provided which includes a free rolling rotor contained in a housing having a nose end portion. The rotor has a number of pockets for receiving ball pistons. Each pocket communicates with a valve port. Pressurized fluid sequentially passes through each valve port to the pocket with which the particular valve port communicates. In the pocket accessed by the pressurized fluid, a fluid chamber is created. The ball piston prevents the escape of fluid outwardly of the rotor. The pressurized fluid, in each accessed fluid chamber, causes the rotor to roll in the housing. The rotor rolling around within the housing applies centrifugal forces to the inside wall of the housing to produce vibrations. The fluid escapes from the rotor using the same valve ports which deliver the pressurized fluid. In addition, an assembly is provided in the housing to prevent the separation of the nose end portion from the housing when the nose end portion becomes worn and tends to separate from the housing.

4 Claims, 10 Drawing Figures

CONCRETE VIBRATOR

FIELD OF THE INVENTION

The present invention relates to a vibrating device and, in particular, to a vibrator having a free rolling rotor with ball pistons for use in creating unbalanced pressure areas to drive the rotor within a housing.

BACKGROUND ART

Various configured vibrators and vibrator rotors have been designed and developed for use in compacting or settling concrete. In one class of vibrators, the rotors have passages in which vanes slidably move as the rotor moves eccentrically in the vibrator housing. The vanes successively extend and engage the inner wall of the housing to form chambers between the inner wall of the housing and the outer surface of the rotor. The chambers receive fluid to create a pressure difference outside the rotor and to cause the eccentric movement of the rotor. In another class of vibrators, the rotor is not free running, rather, the rotor is journaled and supported in bearings in its movement within the vibrator housing. In another type of free rotor, the rotor acts like a turbine due to the velocity of pressurized fluid exiting jets formed in the rotor.

In still another type of free rotor, in which the present invention may be included, the rotor includes pistons placed in passages formed in the rotor. A chamber of pressurized fluid can be provided inside the rotor to create an unbalanced state to eccentrically move the rotor in the vibrator housing. In contrast to previously known vibrators of this type, the present invention incorporates pistons shaped like balls and dual-function valve ports, each of the valve ports both delivering pressurized fluid and exhausting fluid after it has done its work. In addition, the present invention incorporates novel means for preventing the separation of a portion from the housing after it has become worn and begins to break away from the housing. Such separation prevention means can be utilized in all classes of vibrators which may experience this type of failure mode.

STATEMENT RELATING TO PRIOR ART

U.S. Pat. No. 3,235,230 to Malan issued Feb. 15, 1966 discloses a free rotor vibrator in which the rotor is caused to roll around the inside of a race. This free rotor vibrator is characterized by cylindrical-shaped plungers, each having a disc-shaped head. Each of the plungers reciprocates in a cylinder. The cylinder head contacts the race as the rotor rolls around the race. This vibrator also includes pressure valving ports and separate exhaust valving ports. The pressure valving ports receive pressurized fluid to drive the rotor while the exhaust valving ports exhaust or discharge the fluid after it has performed its function.

In contrast, the present invention uses ball pistons which are radially movable relative to the cylindrical body of the rotor. The ball pistons reduce friction to minimize wear of the race, as well as wear of the ball pistons themselves, and thereby improve efficiency of vibrator operation. The fatigue life of each piston is also increased because of the ball configuration. This results since the point of contact of the ball piston against the housing is always changing because the ball piston is rolling. In addition, the use of the ball piston prevents the occurrence of side or binding forces where the piston contacts the housing, unlike the cylindrical plunger, which configuration does result in such binding forces which hinder smooth rotor and piston movement and produce undesired wear.

U.S. Pat. No. 3,650,509 to Swerdfeger issued Mar. 21, 1972 describes a free rotor vibrator characterized by a plurality of cylindrical passages for housing movable cylindrical plungers. The rotor also includes pressure supply passages and separate exhaust passages.

U.S. Pat. No. 2,187,088 to Malan issued Jan. 16, 1940 relates to a free rotor vibrator characterized by a number of movable vanes which act to define fluid chambers during the rolling movement of the rotor.

U.S. Pat. No. 4,293,231 to Lyle issued Oct. 6, 1981 provides a free rotor characterized by a number of jets which successively communicate with pressurized fluid. This rotor configuration also includes a port through the center of the rotor and a recess for receiving fluid which acts to support the rotor so it does not stall or bind in the housing during operation.

DISCLOSURE OF THE INVENTION

In accordance with the present invention, a vibrator is provided which includes a housing having a nose end portion and a free rotor contained in the housing. At about the longitudinal center of the rotor and at the periphery thereof, a number of recessed housings or pockets are formed. A ball piston is placed and held in each pocket. The ball pistons are used to prevent escaping of pressurized fluid from the pocket into the housing interior defined by the space between the inner wall of the housing and the outer surface of the rotor. Also formed in the rotor are a number of valve ports. The number of valve ports corresponds to the number of ball pistons. Each valve port communicates with one pocket. Each valve port is sequentially accessed to provide a fluid path for pressurized fluid through the accessed valve port to the pocket in communication with the accessed valve port. The same valve ports are also sequentially accessed to provide a fluid path for exhaust fluid held in the pocket from the accessed valve port to an outlet member in order to remove or exhaust the fluid. Also contained in the housing is a safety plate having a threaded shaft joined thereto. The rotor is supported on the safety plate while the threaded shaft threadedly engages the housing end portion. In the event that the end portion should become worn, the safety plate acts to prevent complete separation and escape of the end portion because of a difference in the size of the safety plate.

Pressurized fluid is delivered to the rotor using an inlet member. The inlet member is aligned with at least a portion of one of the valve ports at each instance of time. Through a then accessed valve port, the pressurized fluid passes into the pocket with which the accessed valve port communicates. The pressurized fluid acts to move the ball piston in the pocket against the race of the inner wall housing so that a chamber of fluid is created inside the rotor between the surface of the ball piston and an inner wall of the pocket. The fluid in the chamber causes the rotor to rotate. As the rotor rotates, successive valve ports and ball pistons are accessed by the pressurized fluid. At the same time at least one of the valve ports is being used to carry pressurized fluid to its corresponding pocket, at least another one of the valve ports and its corresponding pocket is in communication with the outlet member to exhaust any fluid held therein. The rotor rolling inside of the housing applies a centrifugal force to the inner wall of the housing. This force moves the housing of the vibrator against the material being subjected to vibration, e.g., wet concrete.

Based on the foregoing, a number of worthwhile advantages of the present invention are readily discerned. A vibrator is provided having a free rolling rotor contained within a housing to produce vibrations utilizing ball pistons which form unbalanced pressure chambers. The ball pistons reduce friction and the production of heat during movement of the rotor. Since the ball piston is rolling, the point of contact between the ball piston and the housing changes to increase the fatigue life of the ball piston. Since a ball piston is used, there are no forces to bind the ball piston with respect to its movement in the pocket and against the race of the housing pocket. In addition, the rotor includes a single set of valve ports for use in both carrying pressurized fluid and exhausting fluid after it has performed its function. As a consequence, the rotor is more simply made or machined; the end plate for use in the delivery and exhausting of fluid is made less complex; and the power and work done during each revolution of the rotor is increased since less pressurized fluid need be provided in filling only one valve port, not two or more separate ports.

Additional advantages of the present invention will become readily apparent from the following discussion when taken in conjunction with the accompanying drawings.

DETAILED DESCRIPTION OF THE PREFERRED EMBODIMENT

Figure 1:
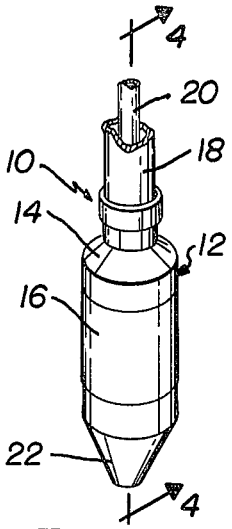
FIG. 1 is a side elevational view of the present invention connected to a pressurized fluid hose and an exhaust fluid hose.

With reference to FIG. 1, an exterior view of a vibrator 10 of the present invention is shown. The vibrator 10 includes a housing or barrel 12 including a first casing 14 and a second casing 16. The first casing 14 is connected to an outlet hose 18. An inlet hose 20 is located concentrically within the outlet hose 18 to carry pressurized fluid, such as air, to the vibrator 10. The second casing 16 includes a nose end portion 22. The vibrator 10 can be used to produce vibrations for use in settling concrete.

Figure 2:
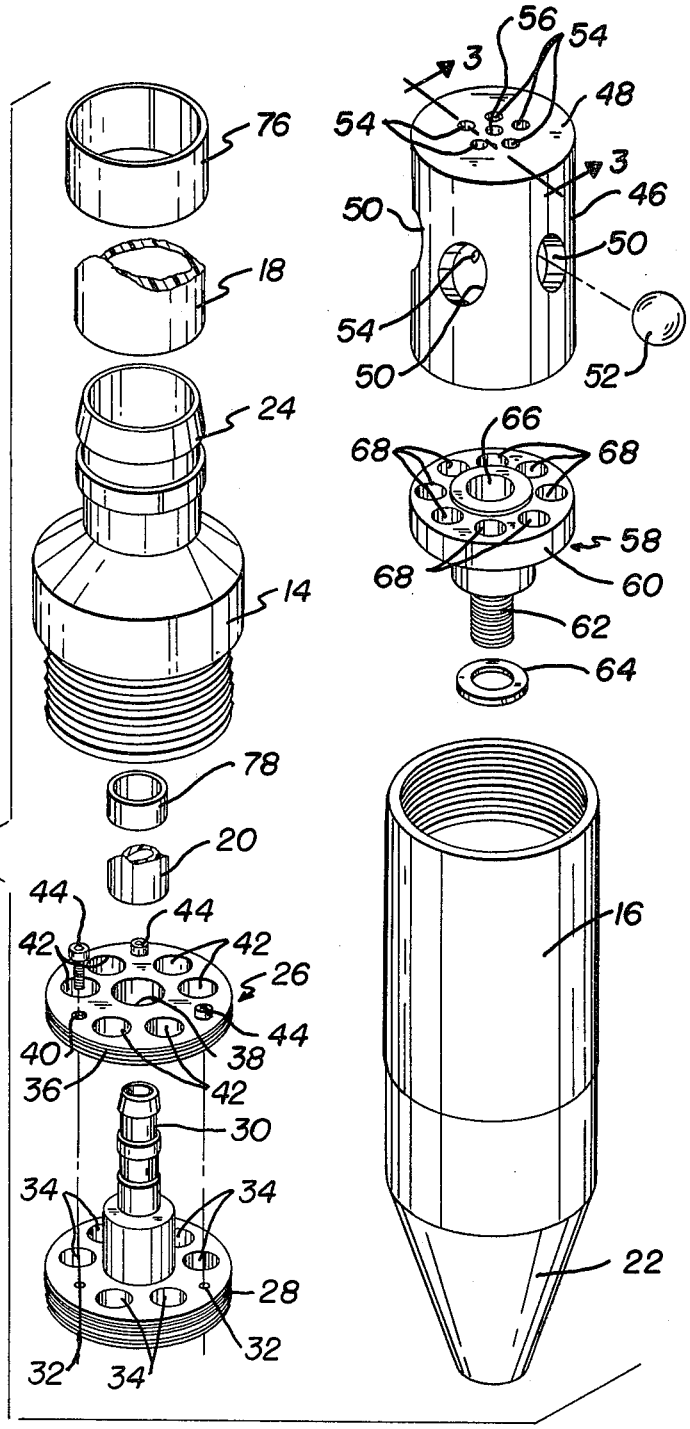
FIG. 2 is an exploded view showing in detail the individual elements of the present invention.
Figure 3:
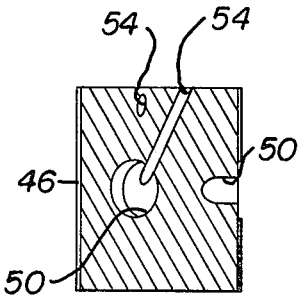
FIG. 3 is a longitudinal section, taken along line 3—3 of FIG. 2, showing the inside of the rotor.

The elements of the vibrator 10 are best seen in FIGS. 2 and 3. The first casing 14 includes an outlet member 24 which is adapted to be surrounded by the outlet hose 18. At the opposite end portion of the first casing 14, external threads are provided. A rotor clearance assembly 26 is located within the housing 12 and includes a clearance plate 28 having external threads located at the circumferential periphery thereof. An inlet member 30 is integrally joined to the clearance plate 28 and extends vertically therefrom. The inlet member 30 is adapted to be surrounded by the inlet hose 20. The clearance plate 28 has a number of holes 32 formed therethrough, the holes 32 are spatially disposed from each other and adjacent to the periphery of the clearance plate 28. A number of exhaust holes 34 are also formed in the clearance plate 28 between holes 32. The rotor clearance assembly 26 also includes a lock plate 36 having external threads formed at the circumferential periphery thereof. The lock plate 36 has a center hole 38 formed of a size so that the inlet member 30 can be received therethrough. Like the clearance plate 28, the lock plate 36 has a number of equally, spatially disposed holes 40 and a number of exhaust holes 42. Screw members 44 are positioned through the unthreaded holes 40 and the lock plate 36 can be aligned with the clearance plate 28 so that the threaded holes 32 of the clearance plate 28 can also receive portions of the screw member 44. Likewise, the exhaust holes 34 of the clearance plate 28 are aligned with the exhaust holes 42 of the lock plate 36. The number of holes 32 and the number of holes 40 are the same and the number of such holes 32, 40 is selected to adequately interconnect the clearance plate 28 and the lock plate 36. The number of the exhaust holes 34 and the number of exhaust holes 42 are the same and the number of such exhaust holes 34, 42 is selected to be sufficient in order to provide openings for exhaust fluid without seriously undermining the rigidity of the clearance plate 28 and the lock plate 36.

The vibrator 10 further includes a rotor 46 having an end surface 48 and a number of pockets or recessed housings 50 formed therein at the periphery thereof and at about the midportion of the longitudinal extent of the rotor 46. Each of the pockets 50 is of configuration or shape to receive a ball piston 52. The ball pistons 52 are shaped as spheres or balls and each is movable relative to the corresponding pocket 50 in which it is received. The rotor 46 also has a number of valve ports or elongated channels 54 formed therein. Each valve port 54 includes a first end located at the end surface 48 of the rotor 46 and a second end located at an inner wall of the rotor 46, which defines the pocket 50. Each second end is immediately adjacent to one of the pockets 50. As illustrated in FIG. 3, each valve port 54 provides a communicating path between the end surface 48 and a corresponding pocket 50 and each valve port 54 is formed at an angle relative to an axis located through the longitudinal extent of the rotor 46. A center port 56 is also formed through the rotor 46 and is aligned with the center longitudinal axis of the rotor 46. The rotor 46 is cylindrical in shape and is of a lesser diameter than the inside diameter of the second casing 16 so that the rotor 46 can be received and held therein.

Fixedly held in the second casing 16 at the nose end portion 22 is a rotor support member 58. The rotor support member 58 includes a safety plate 60, a threaded shaft 62 and a washer 64. The safety plate 60 has a center recess 66 and a number of holes 68.

The connection and cooperation between the various elements of the vibrator 10 is now discussed with reference to FIGS. 4, 5, 6 and 8. The externally threaded shaft 62 of the rotor support member 58 matingly engages a threaded cavity 70 formed in the nose end portion 22 of the second casing 16 so that the rotor support member 58 is fixedly held in the second casing 16.

The safety plate 60 of the rotor support member 58 performs an important function when the vibrator 10 becomes worn and eventually fails. Failure occurs as a result of extensive vibrator use and the vibrator 10 is designed so that it has a relatively weakened circumferential area 72 located at the top portion of the nose end portion 22. This weakened circumferential area 72 is generally of a lesser thickness than the other portions of the second casing 16, including the nose end portion 22. Consequently, "wearing through" of the vibrator 10 will occur along the weakened circumferential area 72. When the wearing through is complete, the nose end portion 22 tends to separate from the remaining portions of the second casing 16. In the case of such initial separation and with the vibrator 10 energized, a complete separation of the nose end portion 22 could cause the end portion 22 to be propelled like a missile. This missile or flying object could cause unwanted and serious injury to a person or property, as well as possibly resulting in a loss of elements of the vibrator 10, such as the rotor 46, which are housed in the second casing 16.

Figure 4:
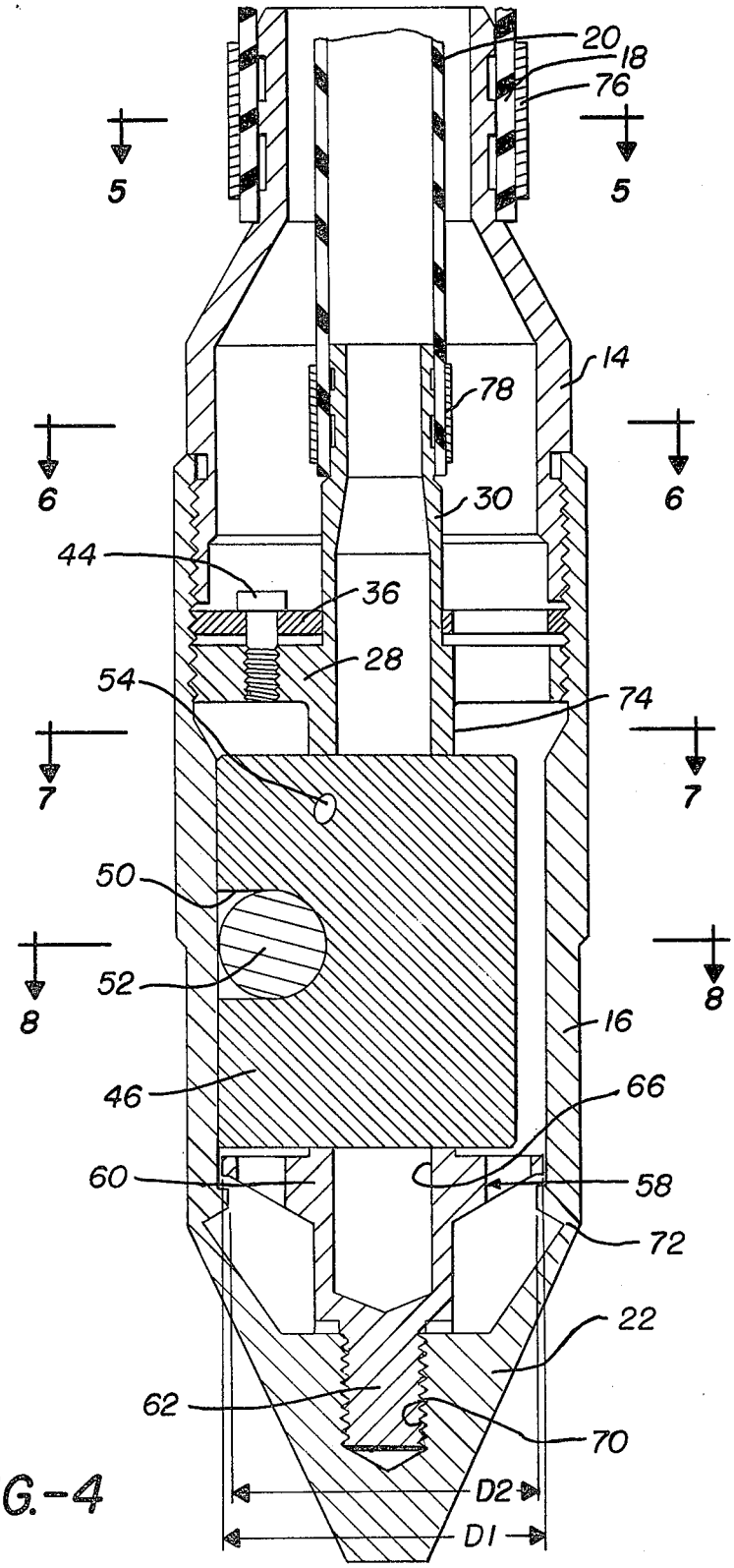
FIG. 4 is an enlarged, longitudinal section, taken along line 4–4 of FIG. 1, showing the elements of the present invention contained in the vibrator housing.
Figure 5:
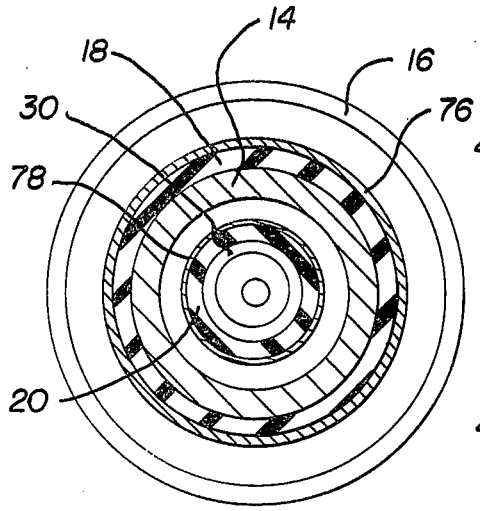
FIG. 5 is a lateral section, taken along line 5—5, of FIG. 4 showing details of the position of various elements of the present invention in the housing.
Figure 6:
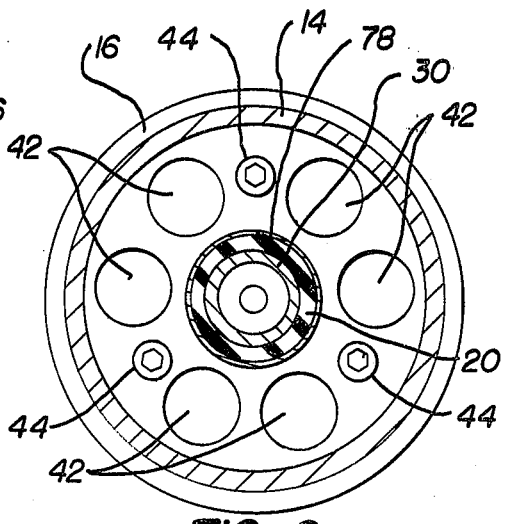
FIG. 6 is a lateral section, taken along line 6—6 of FIG. 4, showing further details of the position of various elements of the present invention in the housing.

A loss of the nose end portion 22 due to wearing through is prevented in the present invention. As can be seen in FIG. 4, the diameter D1 of the safety plate 60 is greater than the diameter D2 of the cross-sectional area defined using the inner wall of the nose end portion located just above the weakened circumferential area 72. Since the rotor support member 58, including the safety plate 60, is threadedly connected to the nose end portion 22, when the nose end portion 22 begins to separate from the second casing 16, the safety plate 60 will act to hold the nose end portion 22 to the second casing 16. This occurs because the safety plate 60 is too great in diameter to escape by the portion of the second casing 16 having the diameter D2. As a consequence, after the weakened circumferential area 72 is worn through, the safety plate 60 moves a short distance away from the casing 16 but is caught at the reduced area having diameter D2. The vibrator 10 ceases to function properly in this state so that the operator using the vibrator 10 is advised of the initial separation and the worn vibrator 10 can be replaced.

The rotor 46 is supported on the safety plate 60 such that the end surface of the rotor 46, opposite that of end surface 48, contacts the surface of the safety plate 60. The centerport 56 of the rotor 46 is aligned with the center recess 66 of the rotor support member 58. The diameters of the ball pistons 52 and the inside diameter of the second casing 16 are such that the ball pistons 52 are movable relative to their corresponding pockets 50 and are able to contact the inner wall or race of the second casing 16 but the ball pistons 52 cannot escape or fall from the pockets 50 into the second casing 16. Accordingly, the rotor 46 is able to rotate eccentrically within the second casing 16 and the ball pistons 52 engage the race during the movement of the rotor 46.

Positioned adjacent to the end surface 48 of the rotor 46 is the rotor clearance assembly 26. This assembly is positioned so that the end portion 74 of the inlet member 30 of the rotor clearance assembly 26 is spaced a desired distance away from the rotor end surface 48. This spacing is necessary because, on the one hand, the rotor 46 must be free to rotate without encumbrance by the rotor clearance assembly 26. On the other hand, pressurized fluid is to be delivered from the end portion 74 to the valve ports 54 and the center port 56. It is, therefore, desirable that the leakage of pressurized fluid inputted to the rotor 46 be minimized. Consequently, an optimal position of rotor clearance assembly 26 permits free movement of the rotor 46 and yet minimizes the leakage of pressurized fluid. This positioning can be accomplished using the variable adjustment feature provided by the rotor clearance assembly 26. Specifically, in joining the rotor clearance assembly 26 to the second casing 16, typically, the clearance plate 28 is threadedly rotated so that its end surface engages the end surface 48 of the rotor 46. Then, the rotor clearance assembly 26 is threadedly rotated in the opposite direction away from the end surface 48 so that the rotor clearance assembly 26 is moved backwards a desired distance, which distance can be determined using the pitch of the external threads of the clearance plate 28. In such a manner, a predetermined spacing between the end surface of the end portion 74 and the end surface 48 of the rotor 46 is provided.

The inside diameter of the end portion 74 corresponds to the diameter of the center recess 66 of the rotor support member 58 and is aligned therewith. Pressurized fluid is able to pass from the end portion 74 through the center port 56 and into the center recess 66. Pressurized fluid in the center recess 66 acts as an air bearing to prevent the rotor 46 from engaging the surface of the safety plate 60 and assists in the free rotational movement of the rotor 46 within the housing 12. The lock plate 36 also threadedly engages the internal threads of the second casing 16 and is vertically spaced from the clearance plate 28. The clearance plate 28 and the lock plate 36 are fixedly held together by the screw members 44. The clearance plate 28, lock plate 36, and screw members 44 cooperate to lock the rotor clearance assembly 26 in a desired position relative to the rotor 46. After the clearance plate 28 is at the desired position, the screw members 44 are used to interconnect the two plates 28, 36 such that the heads of the screw members 44 engage the lock plate 36 and the shafts of the screw members 44 engage the internal threads of the holes 32 of the clearance plate 28. As a result of this interconnection, vibrations produced by the vibrator 10 during operation do not cause an unthreading or further threading of the rotor clearance assembly 26 relative to the rotor 46.

The exhaust holes 34, 42 of the clearance plate 28 and lock plate 36, respectively, are aligned and they pass exhaust fluid received from the valve ports 54 as will be subsequently discussed. The exhaust fluid is passed through the exhaust holes 34, 42 through the first casing 14, including the outlet member 24, to the outlet hose 18 which is fastened to the outlet member 24 by a conventional fastener 76 which surrounds and tightly engages portions of the outlet hose 18.

Inlet hose 20 is joined to the inlet member 30 by a conventional fastener 78, which surrounds and tightly engages portions of the inlet hose 20, so that a fluid tight seal is provided and leakage of pressurized fluid between the inlet hose 20 and the inlet member 30 is prevented.

Figure 7A:
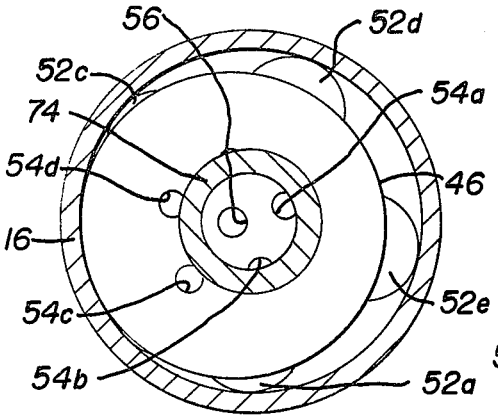
FIGS. 7A–7C are lateral sections, taken along line 7—7 of FIG. 4, showing different positions of the rotor, including ball pistons and valve ports, during movement of the rotor within the vibrator housing.
Figure 7B:
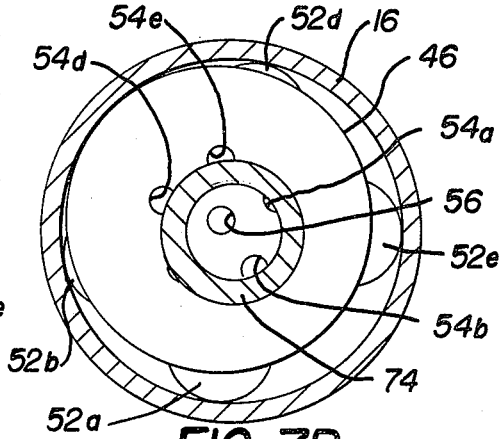
Figure 7C:
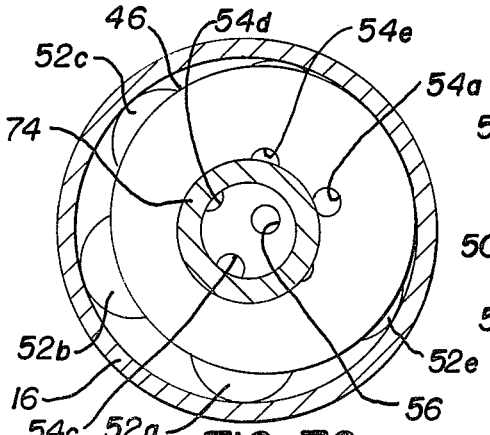
Figure 8:
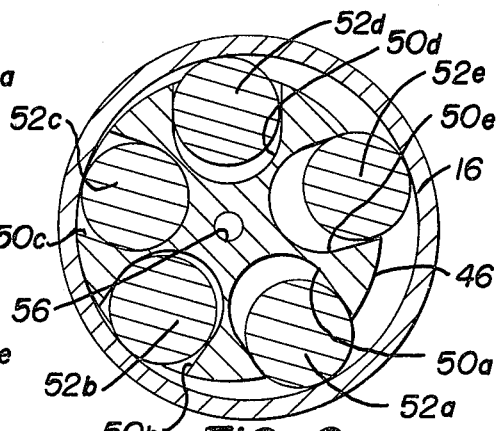
FIG. 8 is a lateral section, taken along line 8—8 of FIG. 4, showing the ball pistons of the present invention.

The operation of the present invention is illustrated in FIGS. 7A–7C in which the rotor 46 rotates clockwise within the second casing 16. In the particular embodiment illustrated, five ball pistons 52*a*, 52*b*, 52*c*, 52*d*, 52*e* are utilized, as best seen in FIG. 8, together with five pockets 50*a*, 50*b*, 50*c*, 50*d*, 50*e* and five valve ports 54*a*, 54*b*, 54*c*, 54*d*, 54*e*. Assuming that the rotor 46 is positioned as shown in FIG. 7A, it is seen that valve port 54*a* and valve port 54*b* are open to or communicate with the pressurized fluid, such as air, exiting the end portion 74 of the inlet member 30. The incoming pressurized air passes through valve ports 54*a*, 54*b*, to the pockets 50*a*, 50*b*, in which the ball pistons 52*a*, 52*b*, respectively, are held. The pressurized air against the ball pistons 52*a*, 52*b* has started to move them outwardly relative to their respective pockets 50*a*, 50*b* and each contacts the inner wall or race of the second casing 16. A pressure chamber is formed by the area defined between the surfaces of the ball pistons 52*a*, 52*b* and the inner walls of their respective corresponding pockets 50*a*, 50*b*. The ball pistons 52*a*, 52*b* prevent the escape of air outwardly of the rotor 46 so that pressurized fluid forces are acting in the defined pressure chambers. These forces in the chambers receiving pressurized fluid produce an unbalanced state in the rotor 46 causing the rotor 46 to rotate within the second casing 16. In the illustration provided, the rotor 46 rotates clockwise to the position of FIG. 7B.

At the same time the valve ports 54*a*, 54*b* of the rotor 46 are receiving pressurized air, the valve ports 54*c*, 54*d* are passing exhaust air to the atmosphere through the outlet member 24 and the outlet hose 18. As depicted in FIG. 7A, the valve ports 54*c*, 54*d* are located "outside" the end portion 74 of the inlet member 30 and each communicates with the outlet member 24. The pressurized air and the formed pressure chambers drive or "push" the rotor 46 so that the pockets 50*c*, 50*d* are moved towards the race of the second casing 16 and receive or surround their corresponding ball pistons 52*c*, 52*d*. In so doing, the forces provided by the pressure of any air in the chambers defined in the pockets 50*c*, 50*d* is overcome and any air contained therein is exhausted as the ball pistons 52*c*, 52*d* approach the inner wall of the pockets 50*c*, 50*d*, respectively. This exhaust air escapes through the valve ports 54*c*, 54*d*.

When the rotor 46 reaches the position illustrated in FIG. 7B, the valve ports 54*a* and 54*b* remain open to pressurized air, the valve port 54*c* is no longer in communication with the outlet member 24 and the outlet hose 18, and the valve port 54*e* is now in communication with the outlet member 24 so that any air contained in the chamber defined by the ball piston 52*e* and the pocket 50*e* is being exhausted.

Continued rotational movement of the rotor 46 results in the rotor reaching the position illustrated in the FIG. 7C. At this position, the valve port 54*a* no longer communicates with the pressurized air. Rather the valve port 54*a* now acts to exhaust the air held in the defined chamber and which air was previously supplied during the time the rotor was in the positions of FIGS. 7A and 7B. Also, the valve port 54*c* and the valve port 54*d* now receive pressurized air while the valve port 54*e* provides a path to exhaust any air it may have.

In this manner of pressurized air being directed sequentially to five different valve ports 54*a*–54*e*, the rotor 46 is caused to roll around inside the second casing 16 and this rolling movement results in centrifugal forces being applied to the inner wall of the second casing 16. The centrifugal forces produce vibrations to move the housing 12 against, for example, wet concrete. The ball pistons 52*a*–52*e* themselves exert a negligible force against the inner wall of the second casing 16. Such a force is negligible in that it is of an order of magnitude less than the centrifugal forces caused by the rotor 46.

With regard to the valve ports 54*a*–54*e*, it is seen that they pass both pressurized air and exhaust air. In particular, each of the valve ports 54*a*–54*e* continuously acts to sequentially receive pressurized air and then discharges the exhaust air. Because there is only one valve port, and not two or more separate inlet and outlet ports, communicating with each of the pockets 50*a*–50*e*, the "air clearance volume" is reduced. The air clearance volume is the volume which must be filled or occupied by air before useful work can be accomplished by the pressurized air. In the case of the present invention, each time a valve port 54*a*–15*e* is accessed by the pressurized air, a single valve port is filled with air before a pressure chamber is formed using the pressurized air to move the rotor 46. In the case of vibrators which have two or more ports, all the inlet and the outlet ports must be filled before a pressure chamber can be formed. As a consequence, the single port with the dual function of inputting and outputting air results in less pressurized air wasted, less work lost because of throttling during valve port opening to pressurized air and valve opening to exhaust air, and more power for a given air engine displacement. In addition, the dual functioning valve ports simplify the machining of the free running rotor 46 since the number of valve ports is reduced; such dual functioning valve ports also simplify the machining of end plates, which are aligned with the rotor for use in providing communication with exhaust and supply lines.

In the present invention, the end portion 74 is made so that it has a thickness (distance between its outer diameter and its inner diameter) equal to the diameter of the valve ports 54*a*–54*e*. Consequently, each valve port 54*a*–54*e* cannot be in communication at the same time with both pressurized air and air to be exhausted. With regard to the ball pistons 52*a*–52*e*, each of the ball pistons rotates about its own axis during the rolling movement against the inner wall of the second casing 16. Because of their spherical shape, unlike cylindrical shaped pistons, the movement of the ball pistons 52*a*–52*e* does not cause side loads or binding forces to be generated. The binding force is produced when the end of the cylindrical-shaped piston engages the race of the housing other than at the center point of the piston end. Since the ball pistons 52*a*–52*e* are spherical, there is no "different points" on the surface of the ball pistons 52*a*–52*e* and the type of contact by the ball pistons against the inner wall or race is always the same.

Based on the foregoing description, a number of advantages of the present invention are easily discerned. A free running rotor is provided having ball pistons to form pressure chamber in order to create unbalanced forces and to cause rotor movement and the generation of centrifugal forces. The use of ball pistons reduce friction so that undesired heat production is minimized, part wear is also reduced, and efficiency of vibrator operation is improved. The fatigue life of each ball piston is enhanced because of the rolling movement of the ball piston which results in a continuous stress area change. Each of the valve ports of the present invention functions to pass both pressurized air and the exhaust air after it has performed its intended purpose. As a consequence, less pressurized air is wasted as a result of the reduction in air clearance volume. An adjustable, lock-able rotor clearance assembly is also included to provide a fixed and desired distance between the rotor and the rotor clearance assembly. In addition, in the case of failure with the separating of the end portion from the remaining portions of the housing, safety or holding means is included to prevent the escape or complete separation of the end portion and thereby reduces possible damage to persons and/or property.

What is claimed is:

1. A vibrator, comprising:

a housing having an end portion;

a rotor contained in said housing;

inlet means operatively associated with said housing for supplying pressurized fluid to said rotor so that said rotor rotates in said housing to produce vibrations; and means operatively connected to said end portion of said housing for preventing the separation of said end portion from said housing, said means for preventing separation including a plate positioned adjacent to said end portion of said housing, and a shaft joined to said plate and connected to said housing end portion, said plate being detached from said inlet means, said end portion being held to said housing using said plate when said end portion becomes worn and tends to separate from said housing.

2. A vibrator, as claimed in claim 1 wherein:

said means for supplying includes threaded adjustable clearance means for maintaining a desired space between said rotor and said threaded clearance means, portions of said threaded clearance means threadedly engaging said inner wall of said housing.

3. A vibrator, comprising:

a housing having an inner wall;

a rotor contained in said housing; and means operatively associated with said housing for supplying pressurized fluid to said rotor so that said rotor rotates in said housing to produce vibrations, said means for supplying including adjustable clearance means comprising a clearance plate having threads and being threadedly joined to said housing inner wall adjacent to said rotor and further including means connected to said clearance plate for locking said threaded plate in a desired position relative to said rotor, said clearance plate being threadedly adjusted in position using said locking means so that said means for supplying is threadedly moved to a desired position and fixedly held thereat relative to said rotor.

4. A vibrator, comprising:

a housing having an inner wall and an end portion;

a rotor contained in said housing having a number of valve ports and a number of pockets, each of said valve ports being accessed in a sequential manner to provide both a path for pressurized fluid to a corresponding one of said pockets and a path for exhaust fluid from a corresponding one of said pockets, said rotor being rotated in said housing using the pressurized fluid and said rotor engaging said inner wall of said housing to produce vibrations;

inlet means operatively associated with said housing for supplying pressurized fluid to said rotor;

a number of pistons shaped like balls, each of said ball-shaped pistons being movably held in a corresponding one of said pockets, each of said ball-shaped pistons preventing the escape of fluid from said pockets in which said ball-shaped pistons are located; and means for preventing the separation of said end portion of said housing from said housing, said means for preventing separation including a plate positioned adjacent to said end portion of said housing, and a shaft joined to said plate and connected to said housing end portion, said plate being detached from said inlet means, said end portion being held to said housing using said plate when said end portion becomes worn and tends to separate from said housing.

* * * * *